US008746962B2

(12) United States Patent
Gandini et al.

(10) Patent No.: US 8,746,962 B2
(45) Date of Patent: Jun. 10, 2014

(54) HEAD FOR HIGH PRESSURE HOMOGENISER FOR THE TREATMENT OF PRODUCTS WITH SOLIDS AND FIBRES

(75) Inventors: Marco Gandini, Parma (IT); Simone Grandi, Sala Baganza (IT); Luca Salvarani, Parma (IT); Mauro Bandini, Fornovo Taro (IT)

(73) Assignee: GEA Mechanical Equipment Italia S.p.A., Parma (IT)

( * ) Notice: Subject to any disclaimer, the term of this patent is extended or adjusted under 35 U.S.C. 154(b) by 1088 days.

(21) Appl. No.: 12/305,352

(22) PCT Filed: Mar. 29, 2007

(86) PCT No.: PCT/IB2007/051127
§ 371 (c)(1),
(2), (4) Date: Dec. 17, 2008

(87) PCT Pub. No.: WO2007/148237
PCT Pub. Date: Dec. 27, 2007

(65) Prior Publication Data

US 2009/0202374 A1 Aug. 13, 2009

(30) Foreign Application Priority Data

Jun. 23, 2006 (IT) ..... PR2006A0056

(51) Int. Cl.
*B01F 5/06* (2006.01)

(52) U.S. Cl.
USPC ..... 366/160.4; 366/176.3; 366/267

(58) Field of Classification Search
USPC ..... 366/176.1, 176.2, 176.3, 176.4, 366/267–269, 160.4
See application file for complete search history.

(56) References Cited

U.S. PATENT DOCUMENTS

| | | | | | |
|---|---|---|---|---|---|
| 2,046,223 | A | * | 6/1936 | Trudel et al. | 366/176.3 |
| 2,901,981 | A | | 9/1959 | Wakeman | |
| 3,818,807 | A | * | 6/1974 | Semple | 92/86.5 |
| 4,233,886 | A | * | 11/1980 | Balzano et al. | 92/86.5 |
| 4,477,236 | A | | 10/1984 | Elliott | |
| 4,691,620 | A | * | 9/1987 | Kao | 92/80 |
| 4,773,833 | A | | 9/1988 | Wilkinson et al. | |
| 5,273,407 | A | | 12/1993 | Jarchau et al. | |

(Continued)

FOREIGN PATENT DOCUMENTS

| | | |
|---|---|---|
| DE | 27 11 837 B1 | 6/1978 |
| EP | 0 515 914 A1 | 12/1992 |
| EP | 0 568 070 A1 | 11/1993 |
| FR | 1 252 884 A1 | 2/1961 |

*Primary Examiner* — Yogendra Gupta
*Assistant Examiner* — Emmanuel S Luk
(74) *Attorney, Agent, or Firm* — Pearne & Gordon LLP

(57) ABSTRACT

A high pressure homogenizer provided with head for the treatment of products with solids and fibers comprises a block defining a passage for the product from an intake area to a delivery area, a piston movable axially with reciprocating motion in the block to pump the product in said passage, intake and delivery valves positioned internally to the block and operatively active on said passage to open it/close as a function of a motion of the products in the passage. The passage is positioned in the block in position of non-interference with the motion of the piston and the intake and delivery valves have no springs and are operatively inserted in said passage in intermediate position between said intake and delivery areas, to favor the sliding of the products and to prevent the accumulation of substances that are sensitive to shear effects contained in the products themselves.

8 Claims, 2 Drawing Sheets

(56) References Cited

U.S. PATENT DOCUMENTS 5,411,380 A * 5/1995 Bristol et al. ..... 417/454
7,118,349 B2 * 10/2006 Oglesby ..... 417/53
2005/0229975 A1 10/2005 Moe et al.

* cited by examiner

HEAD FOR HIGH PRESSURE HOMOGENISER FOR THE TREATMENT OF PRODUCTS WITH SOLIDS AND FIBRES

TECHNICAL FIELD AND BACKGROUND ART

The present invention relates to a head for a high pressure homogeniser for the treatment of products with solids and fibres, comprising:

- a block defining a passage for the products from an intake area to a delivery area;
- a piston, movable axially in reciprocating motion within the block to pump the products in said passage, from the intake area to the delivery area;
- intake and delivery valves positioned internally to the body and operatively active on said passage to open it/close it as a function of a motion of the products in the passage.

The present invention pertains to the technical sector of high pressure homogenizers or piston pumps for the treatment of products. In particular, the present invention relates to high pressure homogenizers and piston pumps for the treatment of products containing particles, agglomerates or fibres, i.e. substantially liquid products, but subject to the formation of solid portions (e.g., said particles, agglomerates or fibres) during the treatment. It should be noted that products of this kind are also called "shear-sensitive"; in particular, to said type belong products that polymerize by effect of the mechanical stress applied to them during pumping/homogenization.

With regard to high pressure homogenization and pumping, known technical solutions entail the use of heads of the type described below.

A head according to said known technical solutions comprises a block defining in its interior a passage for the products, from an intake area to a delivery area. Within the body is movable a plunging piston. Said piston moves with reciprocating rectilinear motion to pump the products in the passage, from the intake area to the delivery area. In particular, the piston slides in its own seat obtained within the block and interfering with said passage. The piston is movable between an outer dead centre and an inner dead centre, whereat the piston reverses the direction of its motion. The outer dead centre corresponds to the position in which the piston is inserted in the block to the greater extent, whilst the inner dead centre corresponds to the position in which the piston is inserted in the block to the lesser extent (i.e. more retracted relative to the block itself).

Generally, the head comprises a plurality of pistons (e.g. three pistons), connected to a crankshaft, operating in parallel to each other, i.e. actuated by the shaft in such a way that its own reciprocating motions are appropriately offset from each other by an angle of 360°/n where n is the number of pumping pistons.

In this case, the block defines in its own interior, for each piston, a passage for the products, said passage intersecting the area (i.e. the seat defined by the block) in is which the piston moves during its reciprocating motion, according to the travel of the piston. Therefore, each piston, in its motion, interferes with a corresponding passage. In particular, when the piston in its inner dead centre, the passage is substantially free, whereas when the piston is in the outer dead centre, the passage is interrupted, i.e. at least partially occluded, because the piston is inserted within the passage, i.e. the cylinder in which the motion of the piston occurs intersects the pseudo-cylindrical hole having as its axis the axes of the valve assembly. More specifically, during the motion of the piston interfering with the passage, the product substantially flows in an inter-space (or jacket) defined between the piston and the seat in which the piston itself moves.

Therefore, the motion of the piston has the effect of subjecting the products to a strong compression and shear stress, this entailing the formation of filaments, particles, agglomerates or fibres (with the possible polymerization of the product) or of causing its accumulation in the restricted passage areas.

The head also comprises delivery and intake valves, active on the products to enable or prevent the passage according to a motion of the products. In particular, each of said valves comprises a ball connected to a spring and slidably associated to a guide. In the solutions with a plurality of pistons and passages, the head further comprises an intake manifold and a delivery manifold, in which end the passages, so that the intake manifold feeds the products to the various passages (upstream of the action of the pistons) and the delivery manifold receives the products from the same passages (downstream of the action of the pistons). Each valve is positioned at the confluence between a corresponding manifold and the passage whereon it is active.

In this light, the high pressure homogenization or pumping of said products containing elements/portions in solid phase with a head of the known type has some problems.

Said products, within a standard head, tend to accumulate the solid phase dispersed or being formed by effect of the stresses generated by the machine (in particular, by the piston) on the product; said accumulation ultimately prevents the proper operation of the pump or of the homogenizer, blocking in fact the automatic operation of the intake and delivery valves, thereby preventing the pumping of the product.

In particular, through its own research and testing activity, the Applicant has identified some critical areas within the head, corresponding to a particularly high probability of formation or accumulation of said solid portions of the products.

Such critical areas, with reference to the head described above of a known homogenizer, are indicated below.

A first critical area is constituted by the pumping valves, i.e. by the intake and delivery valves, because they are apt to promote the accumulation of said solid portions of the products (fibres, filaments, etc.).

In particular, the spring represents an area of accumulation of solid residues of the products that ultimately prevent the correct axial movement of the ball, hence preventing the opening and closing movement of the valve and consequently the functionality of the machine, which can be restored only disassembling the head and its components for manual cleaning.

A second critical area is constituted by the piston pumping in reciprocating motion relative to its own seat, in particular because of the presence of said inter-spaces which constituted forced passages, with limited cross section, for the products. Moreover, the fact that the motion of the piston in the displacement between the outer dead centre and the inner dead centre and vice versa interferes with said passage, partially obstructing it, prevents the passage of any agglomerates of the product, thereby contributing to create the conditions of generation of solid agglomerates in polymerizing products by effect of the stresses applied to the products.

A third critical area is constituted by the delivery manifold, where to an axial flow of the product coming from the (delivery) valve is associated a tangential flow that impacts on the upper area of the valve, causing an additional accumulation of solid and polymerized parts, especially in the area of the spring and of the valve guide; this effect contributes to the poor operation of the valve and consequently of the homogenizer itself.

Therefore, known homogenizers have various drawbacks, when they are used to process such types of products, and in fact they typically get stopped due to failure or malfunction a short time after processing starts.

FR-A-1252884, which is considered to be the closest prior art, discloses a high pressure homogeniser which does not have a straight passage free of obstacles positioned in the block in position of non-interference with the motion of the piston. Other conventional homogenizing apparatus are known from U.S. Pat. No. 2,901,981 and U.S. Pat. No. 4,773,833.

DISCLOSURE OF INVENTION

An object of the present invention is to eliminate the aforesaid drawbacks and to make available a high pressure homogenizer able to process products effectively and continuously, for long periods even in the presence of solid particles, agglomerates, fibres and polymerized structures of the products.

Said object is fully achieved by the head of the present invention, which is characterised by the content of the claims set out below.

BRIEF DESCRIPTION OF DRAWINGS

This and other objects shall become more readily apparent in the description that follows of a preferred embodiment, illustrated purely by way of non limiting example in the accompanying drawing tables, in which.

BEST MODE FOR CARRYING OUT THE INVENTION

Figure 1:
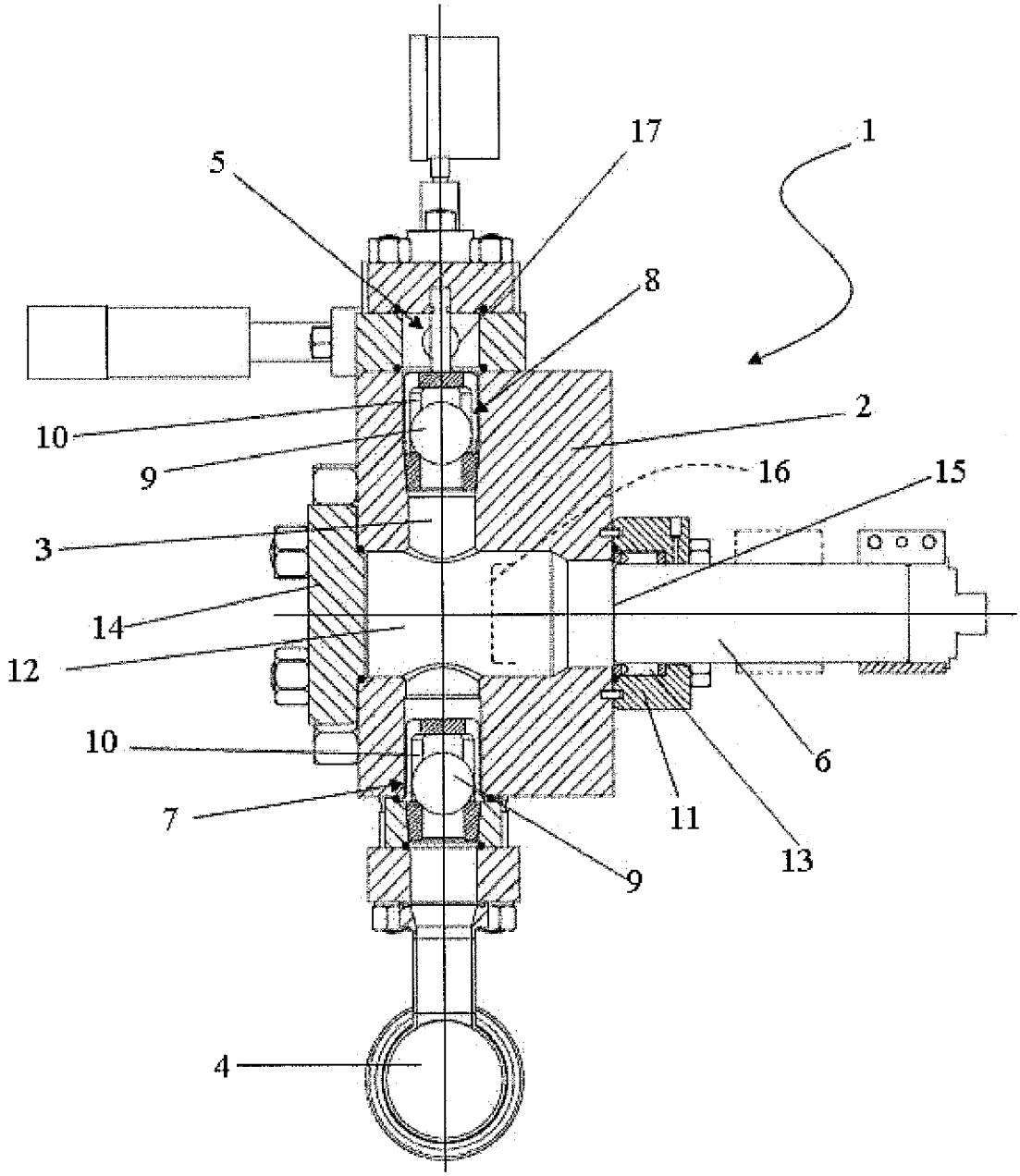
FIG. 1 shows a lateral section view of a homogenizer according to the present invention.

In the figures, the numeral 1 designates a head according to the present invention, in a high pressure homogenizer or pump.

The head 1 is particularly aimed at processing products with solids and fibres. In particular, the head 1 is able to process products containing particles, agglomerates or fibres, or products that are substantially liquid by subject to the formation of solid portions (e.g. by effect of a polymerization), when subjected to mechanical stress during pumping 1 homogenization.

The head 1 comprises a block 2 defining at least one passage 3 for the products from an intake area 4 to a delivery area 5.

The head 1 also comprises a piston 6 movable axially in the body 2 to pump the products in the passage 3, from the intake area 4 to the delivery area 5.

Moreover, the head 1 comprises at least one intake valve 7 and one delivery valve 8. Said intake and delivery valves are positioned internally to the block 2 and are operatively active on said passage 3 to open it/close it as a function of a motion of the products in the passage.

Originally, in the homogenizer of the present invention, and in particular the head 1, the passage 3 is positioned in the block 2 in a position of non interference with the motion of the piston 6 and the intake valve 7 and delivery valve 8 are operatively inserted in said passage 3 in an intermediate position between said intake area 4 and delivery area 5.

In the preferred embodiment illustrated herein, the intake valve 7 and delivery valve 8 have no springs. Moreover, said valves are so shaped as to maximize a useful section for the passage of the products.

In particular, each of said valves comprises a ball 9 movably associated to a guide 10. It should be noted that in the present invention, originally, said guide 10 is so shaped as to facilitate the transit of the products in the passage 3, when the valve is in the open position, minimizing areas defining restrictions of the passage 3 and areas able to promote an accumulation of solid/fibrous/polymerized/agglomerated parts of product (e.g. edges, dead spots or inter-spaces defined by a spring).

The homogenizer according to the present invention comprises a sealing member 11 interacting with the piston 6 and fastened to the block 2 externally relative to a seat 12 for the sliding of the piston 6. Said sealing member 11 provides a seal between the piston 6 and the block 2 of the head 1. It should be noted that said seat 12 shall be called cylinder hereafter, because it typically has substantially cylindrical shape.

In particular, it should be noted that the piston 6 is slidably coupled to the cylinder 12 defined by the head 1. The piston 6 is operatively connected to actuating means (e.g., a crankshaft), that confer to the piston 6 a reciprocating rectilinear motion within the cylinder 12, along a longitudinal axis of the piston 6.

It should be noted that the passage 3 is preferably positioned in the block 2 in such a way as to have a development substantially along a vertical direction, i.e. a direction orthogonal to the axis of the piston 6.

The passage 3 communicates with the seat wherein the piston 6 slides, i.e. with the cylinder 12, so that the piston 6 can exert its pumping action on the products introduced into the passage 3.

It should be noted that, originally, the piston 6 is slidably coupled to the block 2 in such a way that, during its motion, the lateral surface of the piston 6 is separated from the surface delimiting the cylinder 12 by a pre-set distance, to prevent an infiltration of the processed products in inter-spaces defined between said lateral surface of the piston 6 and the block 2. This result is made possible by the fact that the sealing member 11 is originally positioned externally relative to the cylinder 12. In particular, a dynamic gasket 13 is housed within the sealing member 11, which is positioned externally to the block 2 of the head 1, and hence externally to the cylinder 12. In the preferred embodiment illustrated herein, the scaling member 11 is substantially constituted by a flange fastened to the block 2 externally.

It should be noted that, if a sealing member were positioned internally to the cylinder 12 (i.e. in the sliding seat of the piston 6), there would be a need to use a spacer, i.e. an element interposed between the piston 6 and said internal sealing member, thereby entailing an unwanted passage of the products between piston and spacer (through slots obtained in the spacer) during the pumping phases.

The seat (or cylinder 12) in which the piston 6 is movable is delimited by a lateral surface, defined by the block 2, and by a bottom surface that is substantially orthogonal to the axis of the piston 6, or to the direction of motion of the piston itself; moreover, the seat 12 defines an opening in which the piston 6 is inserted.

In the preferred embodiment illustrated herein, said bottom surface delimiting the seat 12 is defined by a frontal flange 14, removably coupled to the block 2. The presence of the frontal flange 14 allows, advantageously, an access to the seat 12 and to the passage 3, for inspection and cleaning operations.

The piston 6 is slidably coupled to the cylinder 12 in such a way that, sliding, it remains at a distance that is no smaller than a minimum predetermined value from said bottom surface, or from the surface of the head 1 delimiting said seat 12 in the direction of sliding of the piston 6.

In particular, said minimum predetermined value of the distance between the piston 6 and the bottom surface of the seat 12 is substantially equal at least to the dimension of the passage 3 evaluated in the direction of sliding of the piston 6.

This advantageously promotes the flow of the products in the passage 3, because the piston 6 does not interfere, in its motion, with the passage 3.

In particular, the piston 6 is movable between an outer dead centre 16 and an inner dead centre 15, whereat the piston 6 reverses the direction of its own motion. The outer dead centre 16 corresponds to the position in which the piston 6 is inserted in the block 2 to the greater extent, whilst the inner dead centre 15 corresponds to the position in which the piston is inserted in the block 2 to the lesser extent (i.e. it is more retracted relative to the body).

In the outer dead centre 16, the piston 6 is in position of non interference with the passage 3. In this light, it should be noted that the outer dead centre 16 of the piston is in retracted position, in order not to invade the vertical passage 3 that houses the valves 7 and 8; this advantageously enables to avoid restrictions in the passage 3, leaving a completely free passage between intake valve 7 and the intake valve 8 for the products.

It should be noted also that the passage 3 is positioned inside the block 2 in asymmetric fashion, relative to the axis of the piston 6. I.e., the thickness of the block 2 evaluated along said axis starting from the passage 3 is greater in a direction of motion of the piston 6 away from the block 2. Therefore, the passage 3 is positioned inside the block 2 in asymmetric fashion, said asymmetry substantially consisting of a greater proximity of the passage 3 to the bottom surface of the seat 12, relative to the opening of the seat 12 itself. This allows, advantageously, to assure a desired travel to the piston 6 (given by the distance between the inner dead centre and the outer dead centre) without the piston 6 interfering with the passage 3.

Figure 2:
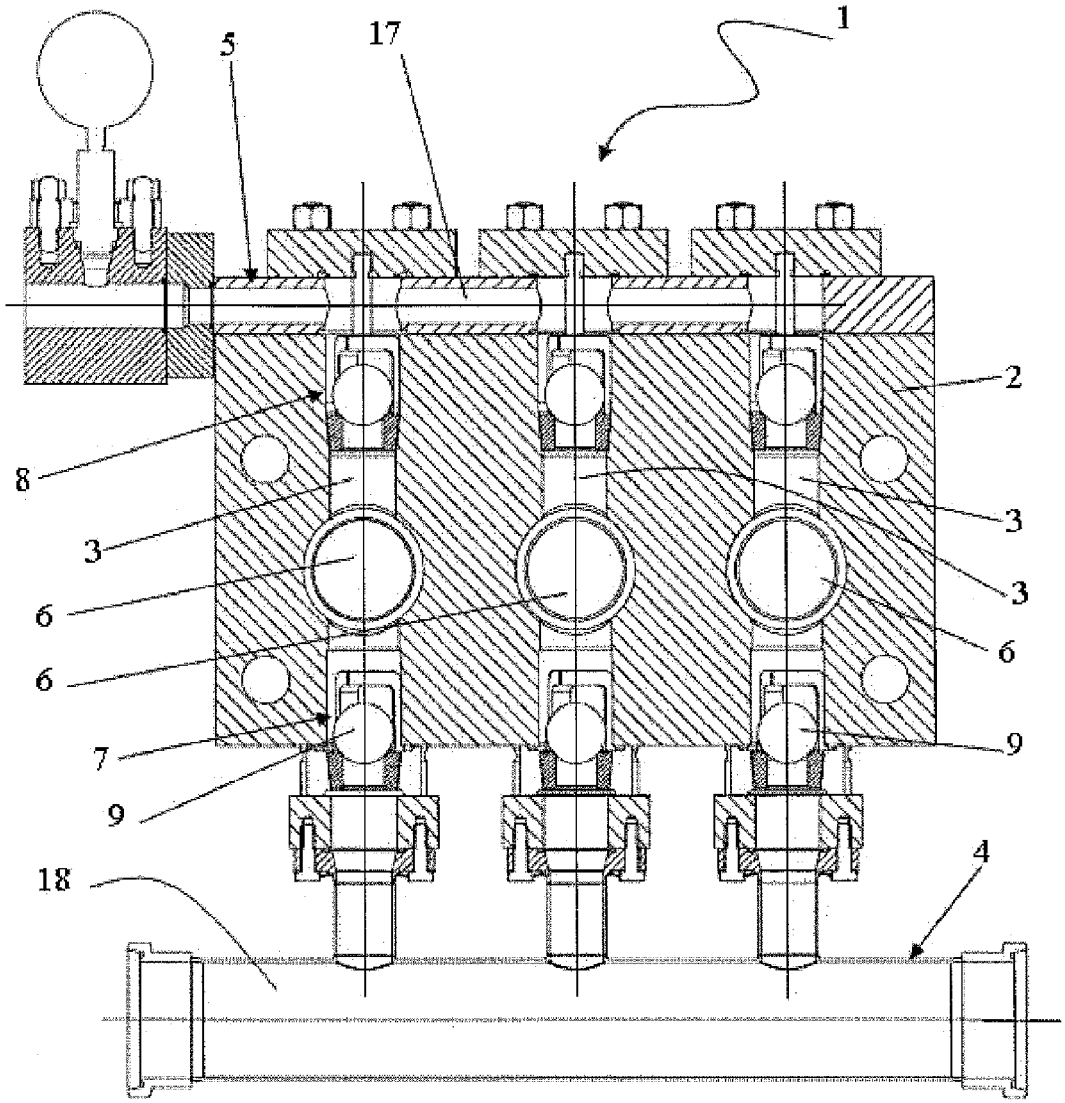
FIG. 2 shows a front sectioned view of the head of FIG. 1.

Preferably, the head 1 is a head in a homogenizer comprising:

- a plurality of pistons 6 (three pistons 6, in the example shown in FIG. 2), each being movably associated to the block 2 to pump the products in a corresponding passage 3;
- and a plurality of intake valves 7 and delivery valves 8 (three intake valves 7 and three delivery valves 8, in the examples shown in FIG. 2), each being positioned internally to the block 8 and operatively active on a corresponding passage 3 to open it/close it as a function of a motion of the products in the passage;
- a delivery manifold 17, able to receive products from each passage 3 to define said delivery area 5;
- an intake manifold 18, able to receive the products in each passage 3, to define said intake area 4.

In the homogenizer according to the present invention, each delivery valve 8 is positioned, originally, in the head 1 at a predetermined distance from said delivery manifold 17.

In particular, each delivery valve 8 is associated to the block 2 is active on a corresponding passage 3, in position distanced from the delivery manifold 17, into which the passage 3 itself ends. In this way, each delivery valve 8 is traversed by a flow of products directed along a vertical direction, i.e. along said axis of the passage 3 (said axis being defined substantially by a line joining the delivery valve 8 and the corresponding intake valve 7).

Thus, the presence of said delivery manifold 17 distanced from the delivery valves 8 originally enables to collect the contribution of flow of products that arrives from each pumping piston 6 (for machines with at least two pistons 6), whilst assuring an operation of the delivery valves 8 with purely axial traversing flow of the products, without tangential contribution of the flow of products inside the delivery manifold 17.

This enables, advantageously, to avoid an accumulation of material on the delivery valves 8, due to a possible tangential flow of products on the valves themselves. It should be noted that the intake valves 7 are associated to the head 1 in position distanced from the intake manifold 18.

Therefore, the homogenizer made available by the present invention originally comprises a passage 3 for the products that is substantially free of obstacles, dead spots or any areas of formation/accumulation of solid pans.

Therefore, the homogenizer made available by the present invention enables, advantageously, to process products with solids and fibres, or containing particles or agglomerates (or in general products subject to polymerization during the treatment) in reliable, efficient fashion, at pressures up to about 600 bar.

The invention claimed is:

1. Head (1) for a high pressure homogeniser for pumping and pressurizing products containing solids and fibres, comprising:

- a block (2) defining a passage (3) for the products from an intake area (4) to a delivery area (5);
- a piston (6) movable axially in the block (2) with reciprocating motion, to pump the products in said passage (3), from the intake area (4) to the delivery area (5);
- intake (7) and delivery (8) valves positioned internally to the block (2) and operatively active on said passage (3) to open it/close it as a function of a motion of the products in the passage, characterised in that, in combination:

- said passage (3) is a straight passage free of obstacles (a) positioned in the block (2) in position of non interference with the motion of the piston (6) and (b) positioned in the block (2) in a direction rectilinear and orthogonal to the axis of the piston (6);
- the intake (7) and delivery (8) valves are operatively inserted in said passage (3) in intermediate position between said intake (4) and delivery (5) area;
- a frontal flange (14) is removably coupled to the block (2) for accessing the passage (3) and a cylinder (12) for the sliding of the piston (6), the cylinder (12) having a lateral surface, the lateral surface of the cylinder (12) adjacent the piston (6) being defined by the block (2);
- a sealing member (11) interacting with the piston (6) and fastened to the block (2) externally relative to the cylinder (12), said sealing member (11) housing a dynamic gasket (13) which is located externally to the block (2) relative to the cylinder (12).

2. The head for a high pressure homogeniser as claimed in claim 1, wherein said intake (7) and delivery (8) valves are free from the presence of springs.

3. The head for a high pressure homogeniser as claimed in claim 1, wherein said intake (7) and delivery (8) valves' shape maximises a useful section for the passage (3) of the products.

4. The head for a high pressure homogeniser as claimed in claim 1, wherein the piston (6) is slidably coupled to the block (2) in the cylinder (12) and during its motion, the lateral surface of the piston (6) is separated from the surface delimiting the cylinder (12) by a pre-set distance, preventing an infiltration of processed products in inter-spaces defined between said lateral surface of the piston (6) and the block (2).

5. The head for a high pressure homogeniser as claimed in claim 1, wherein the piston (6) is slidably coupled to the cylinder (12), and the piston (6), sliding, remains at a distance at least equal to a minimum predetermined value from a surface of the head (1) delimiting said cylinder (12) in the direction of sliding of the piston (6).

6. The head for a high pressure homogeniser as claimed in claim 5, wherein said minimum predetermined value of the distance between the piston (6) and the surface of the head (1) delimiting said cylinder (12) in the direction of sliding of the piston (6) is equal at least to the dimension of said passage (3) in said direction of sliding.

7. The head for a high pressure homogeniser as claimed in claim 1, wherein said passage (3) is positioned inside the block (2) in asymmetric fashion, in that the thickness of the block (2), evaluated along a longitudinal axis of the piston (6) and starting from the passage (3), is greater in a direction towards the piston (6) and lesser in a direction away from the piston (6).

8. The head for a high pressure homogeniser as claimed in claim 1, comprising:

a plurality of pistons (6), each being movably associated to the block (2) to pump the products in a corresponding passage (3);

and a plurality of intake (7) and delivery (8) valves, each being positioned internally to the block (2) and operatively active on a corresponding passage (3) to open it/close it as a function of a motion of the products in the passage (3), a delivery manifold (17), able to receive products from each passage (3) to define said delivery area (4), each delivery valve (7) being positioned in the head (1) at a predetermined distance from said delivery manifold (17).

* * * * *